US009285708B2

(12) United States Patent
Wakimoto

(10) Patent No.: US 9,285,708 B2
(45) Date of Patent: Mar. 15, 2016

(54) IMAGE FORMING APPARATUS

(71) Applicant: KYOCERA Document Solutions Inc., Osaka-shi, Osaka (JP)

(72) Inventor: Atsuhiro Wakimoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/744,709

(22) Filed: Jun. 19, 2015

(65) Prior Publication Data

US 2015/0378279 A1 Dec. 31, 2015

(30) Foreign Application Priority Data

Jun. 27, 2014 (JP) ..... 2014-132967

(51) Int. Cl.
*G03G 15/08* (2006.01)

(52) U.S. Cl.
CPC ..... *G03G 15/0877* (2013.01); *G03G 15/0837* (2013.01)

(58) Field of Classification Search
CPC ..... G03G 15/0877; G03G 15/0837
USPC ..... 399/260, 262
See application file for complete search history.

(56) References Cited

U.S. PATENT DOCUMENTS 7,751,759 B2 * 7/2010 Watanabe et al. ..... 399/262
2013/0195510 A1 * 8/2013 Eto ..... 399/258

FOREIGN PATENT DOCUMENTS

JP 2009080477 A 4/2009

* cited by examiner

*Primary Examiner* — Hoang Ngo
(74) *Attorney, Agent, or Firm* — Alleman Hall McCoy Russell & Tuttle LLP

(57) ABSTRACT

An image forming apparatus includes a toner case, an opening/closing member, a lever member, a drive transmission mechanism, and a biasing member. The toner case is attached to an apparatus main body. The opening/closing member opens and closes a toner discharge outlet formed in the toner case. The lever member is operated between a first operation position and a second operation position for the opening/closing member to be moved to a closing position corresponding to the first operation position or to an opening position corresponding to the second operation position. The drive transmission mechanism transmits, to the opening/closing member, a driving force input by operation of the lever member. The biasing member biases the opening/closing member toward the closing position when the lever member is at the first operation position, and biases the opening/closing member toward the opening position when the lever member is at the second operation position.

8 Claims, 12 Drawing Sheets

IMAGE FORMING APPARATUS

INCORPORATION BY REFERENCE

This application is based upon and claims the benefit of priority from the corresponding Japanese Patent Application No. 2014-132967 filed on Jun. 27, 2014, the entire contents of which are incorporated herein by reference.

BACKGROUND

The present disclosure relates to an image forming apparatus that can open and close a toner discharge outlet through which toner is discharged from a toner case to an apparatus main body.

A developing device is installed in an image forming apparatus such as a copier, a printer or the like that forms an image on a print sheet by the electrophotography. The toner inside the developing device is decreased as the developing device performs the developing. As a result, the image forming apparatus is configured such that a toner case storing toner can be attached to and detached from the image forming apparatus. The toner is supplied from the toner case to the developing device in the state where the toner case is attached to the image forming apparatus. The toner case includes a toner discharge outlet and an opening/closing member (shutter member), wherein the toner is discharged from the toner discharge outlet to outside, and the opening/closing member is configured to open and close the toner discharge outlet. Conventionally, an operation lever, which is attached to the toner case or the apparatus main body, is operated so as to displace the opening/closing member between the opening position and the closing position, thereby allowing the toner discharge outlet to be opened and closed.

SUMMARY

An image forming apparatus according to an aspect of the present disclosure includes a toner case, an opening/closing member, a lever member, a drive transmission mechanism, and a biasing member. The toner case is attached to an apparatus main body. The opening/closing member is configured to open and close a toner discharge outlet formed in the toner case. The lever member is configured to be operated between a first operation position and a second operation position for the opening/closing member to be moved to a closing position corresponding to the first operation position or to an opening position corresponding to the second operation position. The drive transmission mechanism is configured to transmit, to the opening/closing member, a driving force that is input by an operation of the lever member. The biasing member is configured to bias the opening/closing member toward the closing position when the lever member is at the first operation position, and bias the opening/closing member toward the opening position when the lever member is at the second operation position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
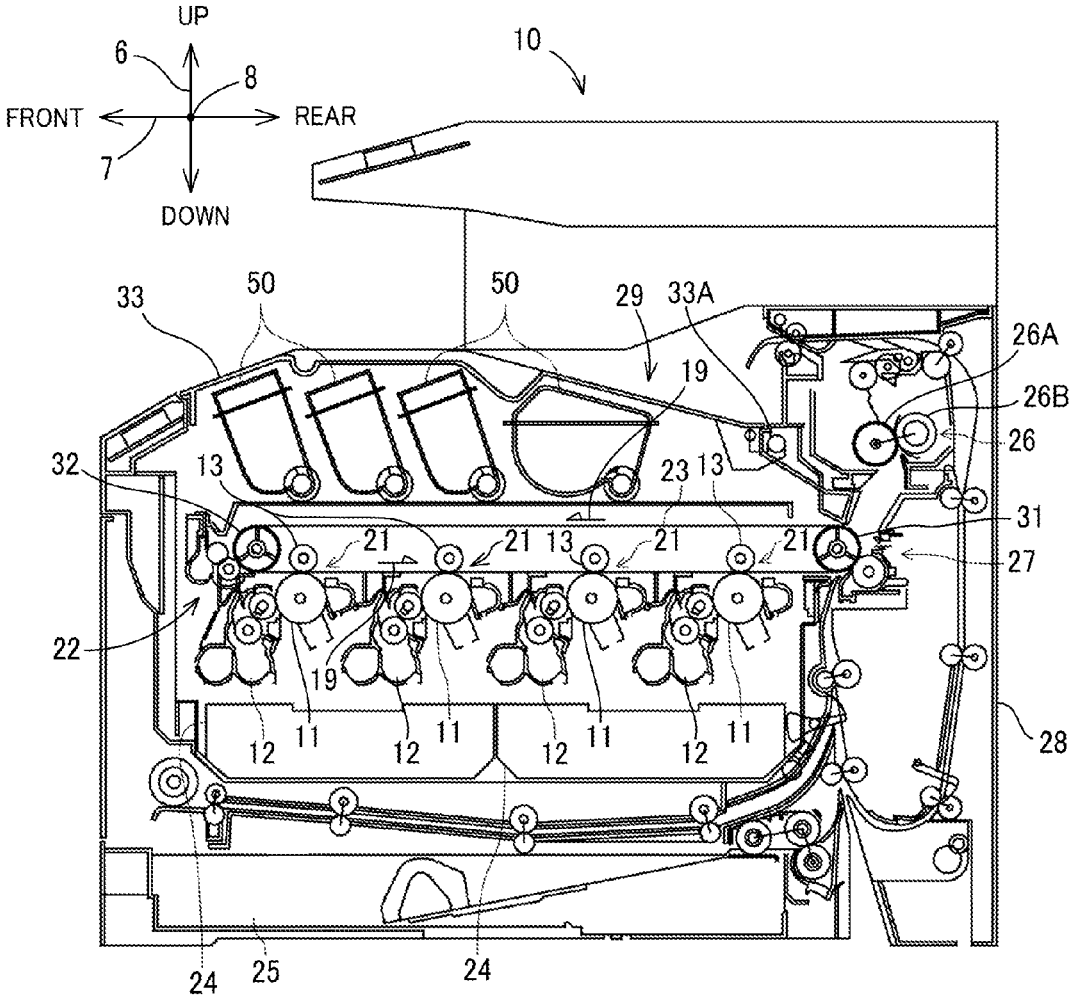
FIG. 1 is a diagram showing the configuration of an image forming apparatus according to an embodiment of the present disclosure.

The following describes an embodiment of the present disclosure with reference to the attached drawings. It should be noted that the following description is an example of a specific embodiment of the present disclosure and should not limit the technical scope of the present disclosure. It is noted that for the sake of explanation, an up-down direction 6 is defined based on the state (the state shown in FIG. 1) where an image forming apparatus 10 in an embodiment of the present disclosure is installed on a flat surface. In addition, a front-rear direction 7 is defined on the supposition that the left side on the plane of FIG. 1 is the front side (front-surface side) of the image forming apparatus 10. Furthermore, a left-right direction 8 (a direction perpendicular to the plane of FIG. 1) is defined based on the image forming apparatus 10 of FIG. 1 viewed from the front side. Accordingly, the front side on the plane of FIG. 1 is the right side, and the depth side on the plane of FIG. 1 is the left side.

[Image Forming Apparatus 10]

The image forming apparatus 10 is an image forming apparatus that includes at least a print function. As shown in FIG. 1, the image forming apparatus 10 is a so-called tandem color printer. The image forming apparatus 10 prints an image on a sheet of print paper by using a developer that contains toner. It is noted that the image forming apparatus 10 may be any apparatus as far as it has the print function. For example, the image forming apparatus 10 may be a multifunction peripheral having a plurality of functions including the print function, or an image forming apparatus such as a FAX apparatus or a copier. Of course, the image forming apparatus 10 may be an apparatus for forming a monochrome image, instead of an apparatus for forming a color image.

As shown in FIG. 1, the image forming apparatus 10 includes, as major components, four image forming portions 21, an intermediate transfer unit 22, a sheet feed device 25, a fixing device 26, a secondary transfer device 27, an exposure device 24, and four toner containers 50 (50A-50D). These components are attached to an apparatus main body 28 that is a housing constituting an external frame (not shown), an internal frame (not shown) and the like of the image forming apparatus 10. It is noted that the toner containers 50 of the image forming apparatus 10 are an example of the toner case.

The four image forming portions 21 are disposed below the intermediate transfer unit 22 in the apparatus main body 28. The image forming portions 21 are aligned along the front-rear direction 7. The image forming portions 21 execute an image forming process to form an image on a print sheet based on the so-called electrophotography. Specifically, the image forming portions 21 print an image on a print sheet based on the image data input from outside via a network communication portion (not shown). Each of the image forming portions 21 includes a photoconductor drum 11, a charging device (not shown), a developing device 12, a primary transfer device 13, and the like. The image forming portions 21 form toner images respectively on the photoconductor drums 11, and transfer the toner images to a transfer belt 23 included in the intermediate transfer unit 22 by overlaying the toner images onto the belt in sequence. The transfer belt 23 moves in a direction indicated by the arrow 19, and the toner images are transferred in sequence to the transfer belt 23 while it is moving. In the example shown in FIG. 1, in order from the downstream side in the movement direction of the transfer belt 23 (the direction indicated by the arrow 19), the image forming portions 21 for black, cyan, magenta and yellow are disposed in a row in the apparatus main body 28.

The intermediate transfer unit 22 is disposed above the image forming portions 21. At opposite ends of the intermediate transfer unit 22 in the front-rear direction 7, a driving pulley 31 and a driven pulley 32 are provided. The transfer belt 23 is suspended between and supported by the driving pulley 31 and the driven pulley 32. As such, the transfer belt 23 extends in the front-rear direction 7 in the state where the belt surface extends horizontally. Supported by the driving pulley 31 and the driven pulley 32, the transfer belt 23 can move (run) in the direction indicated by the arrow 19, with its surface being in contact with the surfaces of the photoconductor drums 11. The transfer belt 23 is a belt formed in the shape of an endless loop and made of rubber, urethane or other material.

The secondary transfer device 27 transfers, from the transfer belt 23 to a print sheet, a color toner image composed of the toner images of the plurality of colors. The print sheet with the color toner image transferred thereon is conveyed to the fixing device 26. The fixing device 26 fixes the color toner image transferred to the print sheet, to the print sheet by heat. The fixing device 26 includes a heating roller 26A heated to a high temperature, and a pressure roller 26B disposed to face the heating roller 26A. In the fixing device 26, the print sheet is conveyed while being nipped by a predetermined biasing force at a nip portion between the heating roller 26A and the pressure roller 26B. This allows the color toner image to be fused and adhered to the print sheet. Subsequently, the print sheet is discharged onto a sheet discharge tray 29 provided on an upper part of the apparatus main body 28.

The image forming apparatus 10 may have a configuration where the transfer belt 23 is used as a conveyance belt, and the toner images are overlaid directly on a print sheet that is being conveyed on the conveyance belt. In addition, the image forming apparatus 10 may have a configuration where an intermediate transfer member in the shape of a roller is used in place of the transfer belt 23.

The four toner containers 50 (50A-50D) are disposed above the intermediate transfer unit 22. Inside the apparatus main body 28, the four toner containers 50 are aligned in a row along the transfer belt 23 in the front-rear direction 7. The toner containers 50 are configured to supply toner to the developing devices 12 of corresponding colors.

Figure 2:
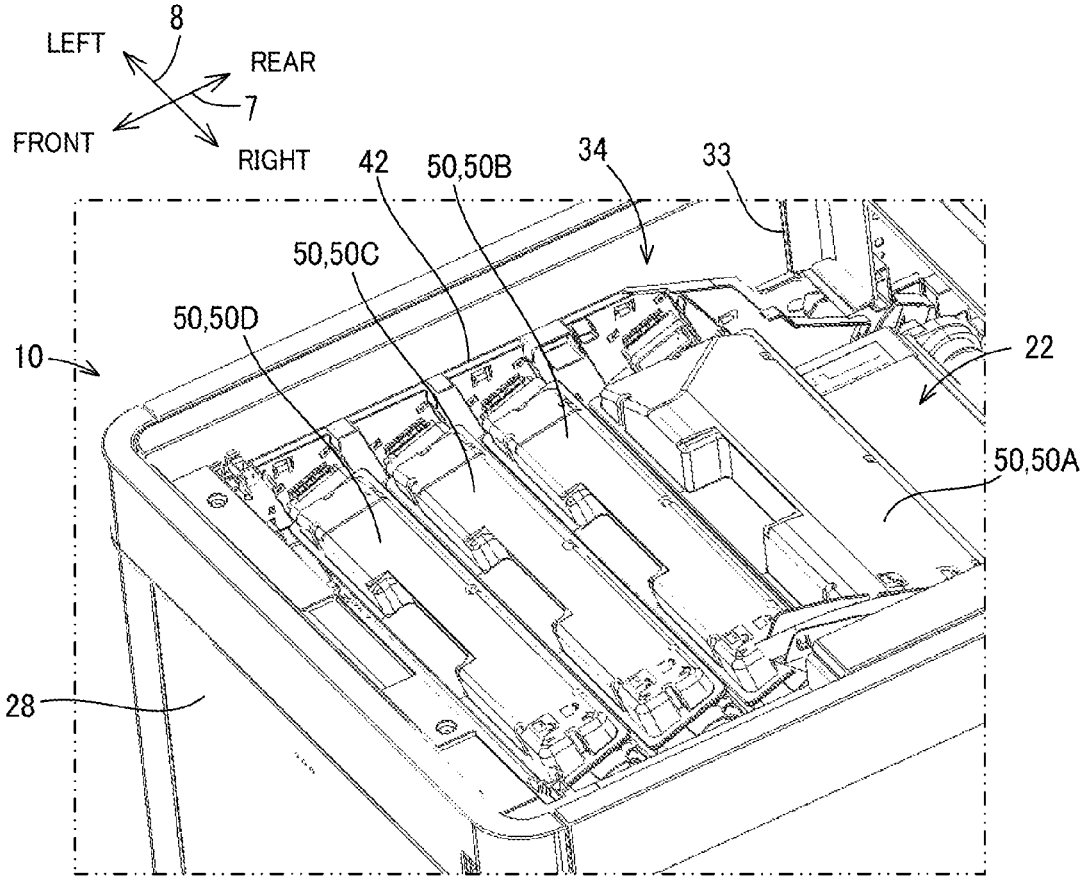
FIG. 2 is a perspective view showing a state where a toner container is attached to an intermediate transfer unit of the image forming apparatus.

As shown in FIG. 2, an attachment portion 34 to which the plurality of toner containers 50 are attached is provided in the apparatus main body 28. Specifically, the attachment portion 34 is provided above the intermediate transfer unit 22. A top cover 33 provided on the upper part of the apparatus main body 28 is supported so as to be opened and closed around a spindle 33A of the apparatus main body 28 (see FIG. 1). When the top cover 33 is pivoted upward (in the opening direction), the attachment portion 34, to which the toner containers 50 are attached, is exposed. The attachment portion 34 is integrally formed with the upper part of the intermediate transfer unit 22, and the toner containers 50 are attached to be stored in the attachment portion 34. It is noted that the attachment portion 34 is not limited to the one integrally formed with the upper part of the intermediate transfer unit 22, but may be attached to the apparatus main body 28 as a member independent of the intermediate transfer unit 22.

The toner containers 50 store toner of different colors that correspond to the colors of the image forming portions 21. Specifically, the toner containers 50 (50A-50D) store toner of black, cyan, magenta, and yellow, respectively. As shown in FIG. 1 and FIG. 2, among the four toner containers 50, the toner container 50A positioned on the most rear side is a large-capacity type and can store a larger amount of toner than the other toner containers 50B-50D. The toner container 50A stores black toner. The toner containers 50B-50D have the same shape and capacity. The toner container 50B stores cyan toner, the toner container 50C stores magenta toner, and the toner container 50D stores yellow toner.

[Configuration of Toner Containers 50]

The following describes the configuration of the toner containers 50. It is noted here that the large-capacity-type toner container 50A and the other toner containers 50B-50D have the same configuration except for the size of the toner storing part. In addition, the toner containers 50B-50D have the same configuration except for the arrangement position. As a result, in the following description, the toner containers 50A-50D are described as a toner container 50.

Figure 3:
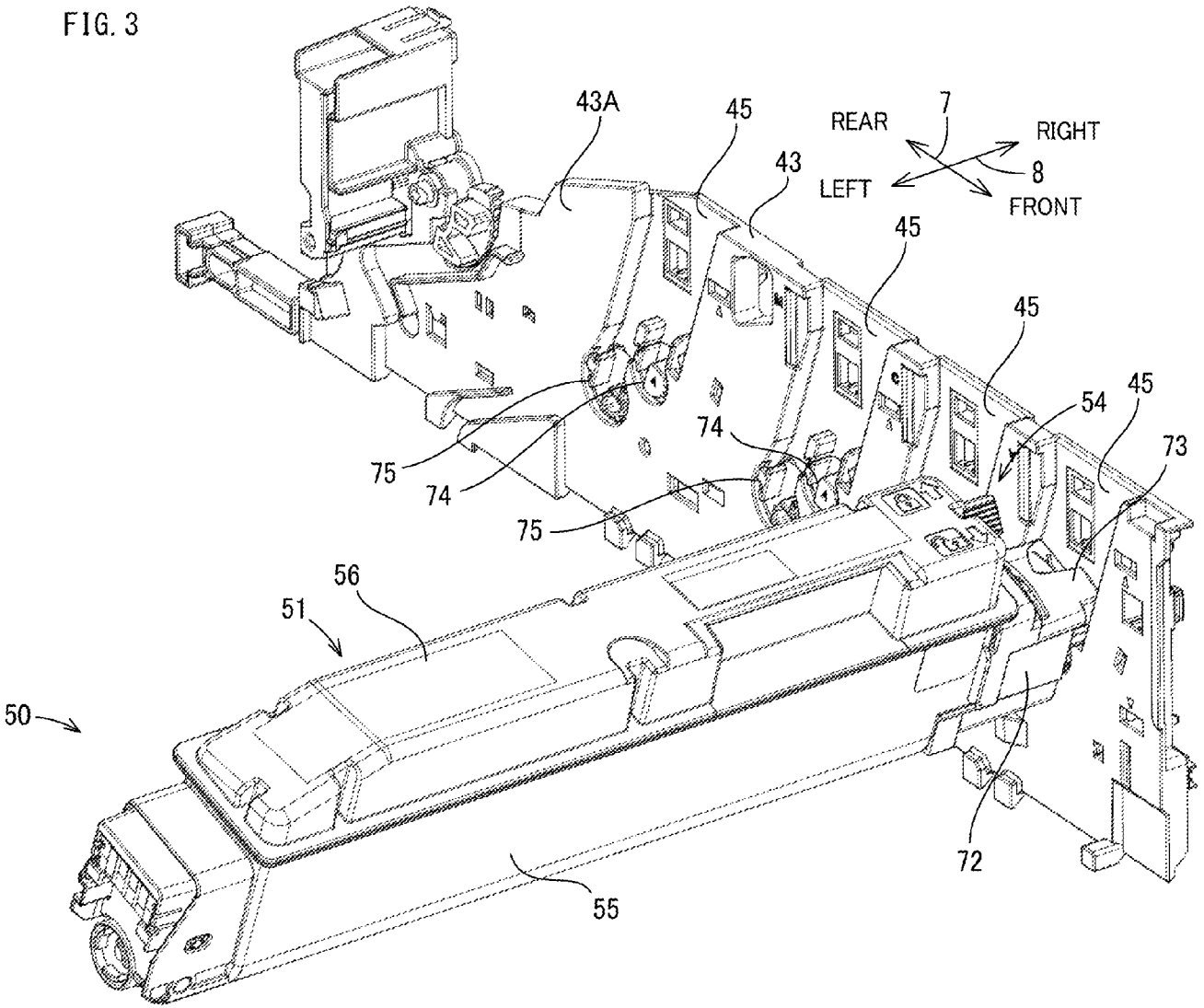
FIG. 3 is a perspective view showing the toner container and an attachment portion thereof.
Figure 4:
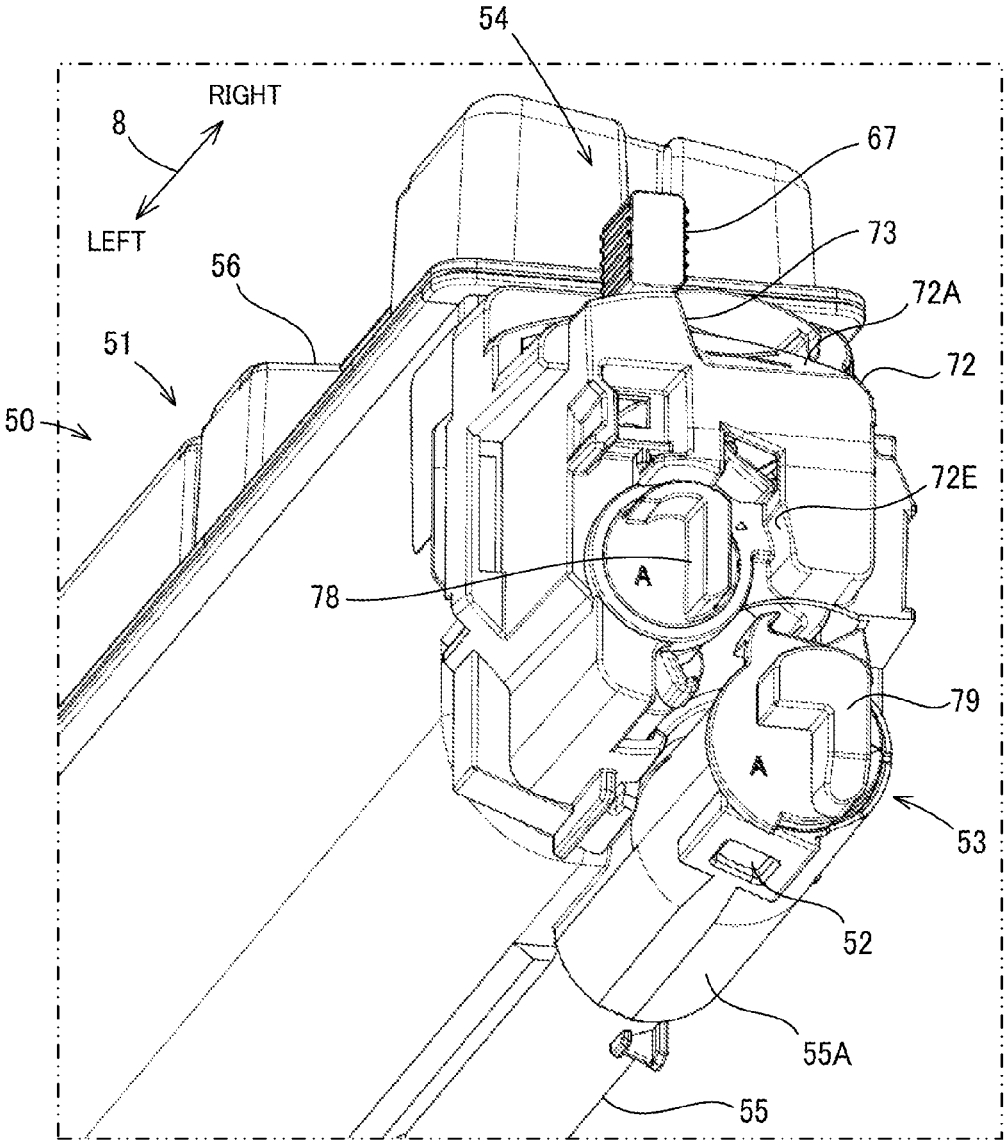
FIG. 4 is a side view showing the configuration of the right side portion of the toner container.
Figure 5:
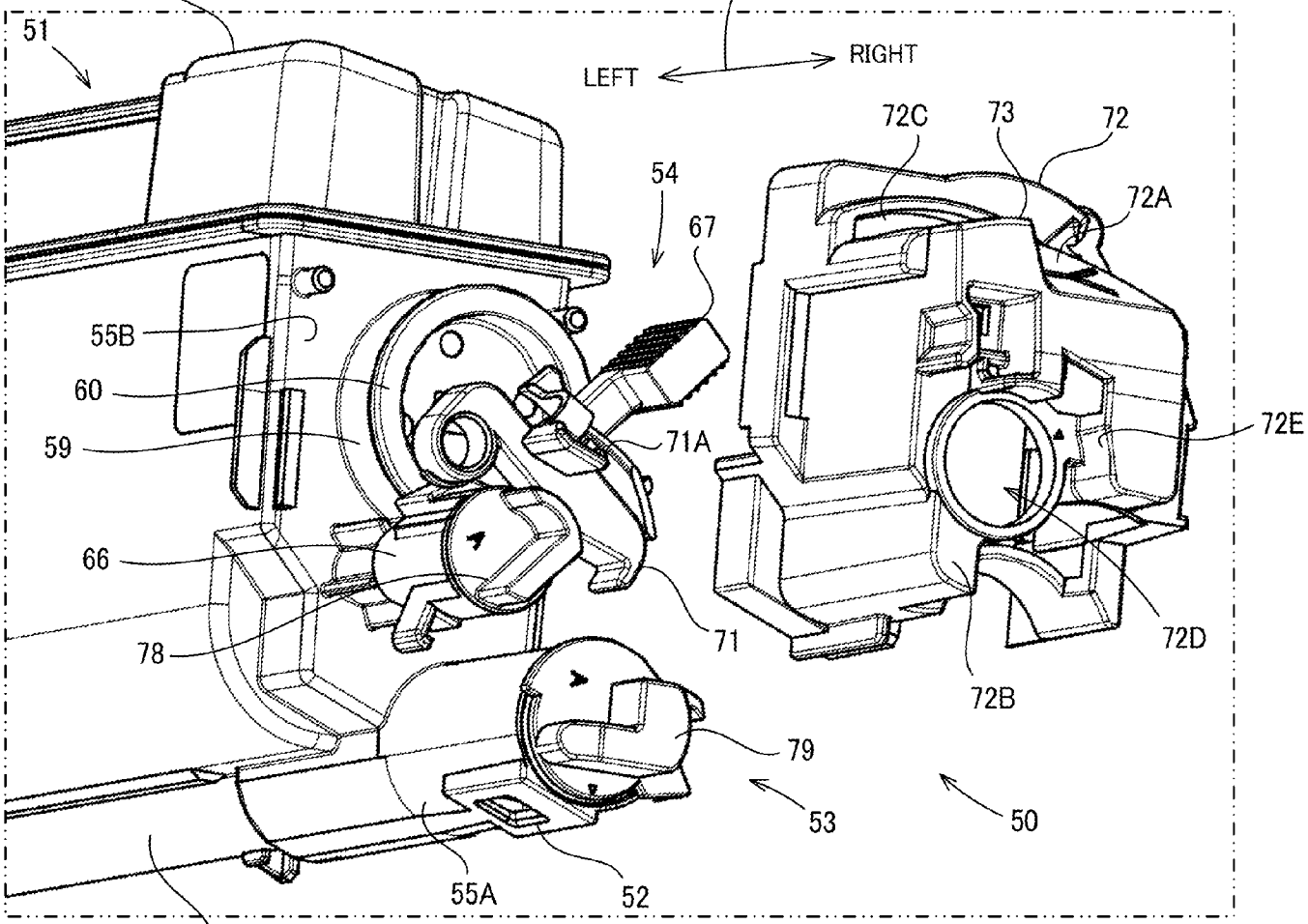
FIG. 5 is a side view showing the configuration of the right side portion of the toner container.

The toner container 50 stores toner that is to be supplied to the developing device 12. As shown in FIG. 3 to FIG. 5, the toner container 50 includes a housing 51, a toner discharge outlet 52 (see FIG. 4), an opening/closing mechanism 53 (see FIG. 4), an operation portion 54, and a cover 72. The opening/closing mechanism 53 is an example of the opening/closing member of the present disclosure. The housing 51 is attached to the attachment portion 34 of the image forming apparatus 10. Toner is stored in the housing 51. As shown in FIG. 4, the housing 51 has the toner discharge outlet 52. The toner discharge outlet 52 is formed in the bottom of the housing 51 at the right end thereof. In addition, as shown in FIG. 5, the operation portion 54 is provided on the housing 51 so as to be operated by the user.

As shown in FIG. 2 and FIG. 3, the apparatus main body 28 includes support plates 42 and 43 to which the housing 51 is attached. The support plates 42 and 43 are formed plate-like and extend in the front-rear direction 7. The support plates 42 and 43 are disposed to face each other in the attachment portion 34. As shown in FIG. 2, the support plate 42 is erected at the left end of the attachment portion 34. As shown in FIG. 3, the support plate 43 is erected at the right end of the attachment portion 34. The support plates 42 and 43 support opposite ends of the four toner containers 50 respectively.

On a left side surface 43A (see FIG. 3) of one side (the left side) of the support plate 43, a plurality of groove-like container guides 45 are formed to extend diagonally upward. The container guides 45 are formed groove-like by recessing the left side surface 43A of the support plate 43 in the thickness direction. In addition, an end portion of each container guide on the upper part side of the support plate 43 is formed to spread upward. The right end portion of the housing 51 is attached to the support plate 43 by being guided by the container guide 45 diagonally downward from the upper end of the support plate 43.

The housing 51 is made of a resin material, and is, as shown in FIG. 3, formed in the shape of a box that is long in the left-right direction 8. That is, the longitudinal direction of the housing 51 matches the left-right direction 8 of the image forming apparatus 10 shown in FIG. 1.

As shown in FIG. 3, the housing 51 includes a container main body 55 and a lid portion 56. The container main body 55 is formed in the shape of a box which has a bottom and whose upper part is opened. The lid portion 56 closes the upper opening portion of the container main body 55. Inside the container main body 55, a stirring paddle (not shown) and a screw portion 58 (see FIG. 8) are provided, wherein the stirring paddle is configured to stir the toner, and the screw portion 58 is configured to convey the toner to the toner discharge outlet 52.

As shown in FIG. 5, the cover 72 is provided in such a way as to cover a right side wall 55B of the container main body 55. The side wall 55B is provided with a toner filling port 59 that allows the toner to be filled into the housing 51. The toner filling port 59 is closed by a plug member 60.

Figure 8:
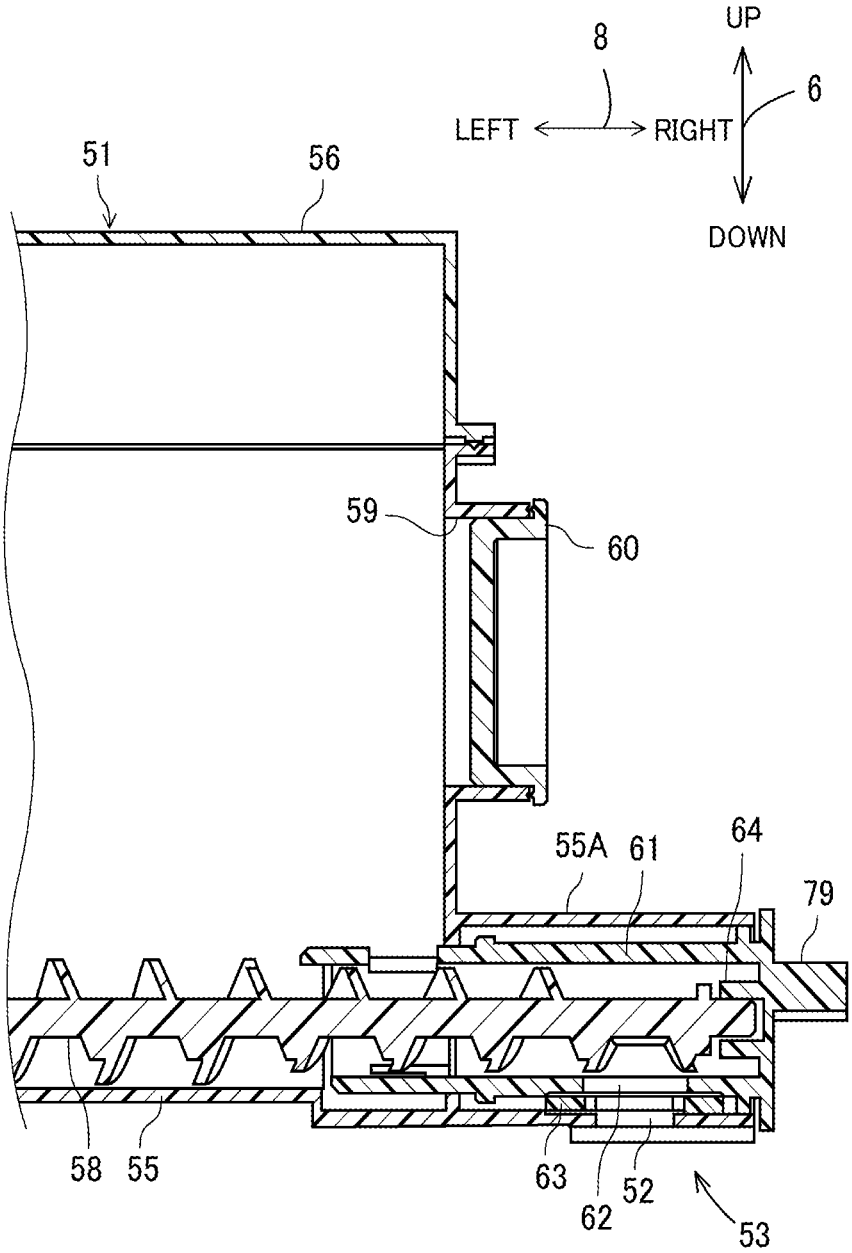
FIG. 8 is a cross sectional view showing a cross-sectional configuration of the right side portion of the toner container.

As shown in FIG. 4, FIG. 5, and FIG. 8, the toner discharge outlet 52 is formed in the toner container 50. Specifically, the toner discharge outlet 52 is formed in the bottom of the container main body 55 at the right end thereof. The toner discharge outlet 52 is formed in such a way as to pass through the bottom wall of the container main body 55 downward. Specifically, as shown in FIG. 8, a protruding portion 55A is formed at the right end of the container main body 55, wherein the protruding portion 55A is in an approximate shape of a cylinder protruding and extending rightward. The toner discharge outlet 52 is formed in such a way as to pass through the circumferential wall of the protruding portion 55A downward.

The opening/closing mechanism 53 opens and closes the toner discharge outlet 52, and as shown in FIG. 8, includes a cylinder 61, an opening 62, a seal member 63, and a second coupling portion 79. The cylinder 61 is formed in the shape of a cylinder and inserted in the protruding portion 55A that is provided at the right end of the container main body 55. The right end portion of the cylinder 61 is closed. In addition, the right end portion of the cylinder 61 is integrally formed with the second coupling portion 79 that is described below. The opening 62 is formed in a side surface (lower surface) of the cylinder 61. Furthermore, the seal member 63 is provided on an inner wall surface of the protruding portion 55A at the peripheral of the toner discharge outlet 52. The seal member 63 is provided for prevention of scattering of toner.

A bearing 64 is formed inside the cylinder 61 at the right end thereof. An end of the screw portion 58 is supported by the bearing 64 such that the screw portion 58 can rotate in the cylinder 61.

The cylinder 61 is attached so as to be rotatable with respect to the protruding portion 55A. When a rotational force is input to the second coupling portion 79, the cylinder 61 is rotated. When the cylinder 61 rotates and the opening 62 of the cylinder 61 overlaps with the toner discharge outlet 52, the toner discharge outlet 52 is opened as shown in FIG. 8. Hereinafter, the position of the cylinder 61 (the position shown in FIG. 8) that allows the toner discharge outlet 52 to be opened is referred to as an "opening position". When the cylinder 61 is rotated to the opening position, toner in the housing 51 is discharged from the toner discharge outlet 52 to outside smoothly. On the other hand, when the cylinder 61 rotates and the circumferential wall of the cylinder 61 except for the opening 62 overlaps with the toner discharge outlet 52, the toner discharge outlet 52 is closed by the circumferential wall of the cylinder 61. Hereinafter, the position of the cylinder 61 where the toner discharge outlet 52 is closed is referred to as a "closing position". When the cylinder 61 is rotated to the closing position, the toner discharge outlet 52 is completely closed.

With the rotation of the second coupling portion 79, the cylinder 61 is displaced between the opening position and the closing position. That is, the toner discharge outlet 52 is opened and closed with the rotation of the cylinder 61. When the toner container 50 is attached to the attachment portion 34, the second coupling portion 79 is coupled with a drive transmission mechanism 76 (see FIG. 9 to FIG. 12C) that is provided in the apparatus main body 28 (specifically, in the attachment portion 34). This allows the second coupling portion 79 to receive the rotational force from the drive transmission mechanism 76. It is noted that the drive transmission mechanism 76 and the second coupling portion 79 are described in detail below.

When the toner container 50 is attached to the attachment portion 34, the toner discharge outlet 52 is disposed in front of a communication port (not shown) that is formed in the intermediate transfer unit 22, and becomes in close contact with the communication port. The toner is supplied from the communication port to the developing device 12 via a conveyance path (not shown). The attachment position of the toner container 50 in the attachment portion 34 is determined so that the above-described positional relationship is satisfied. The operation portion 54 is used to open and close the toner discharge outlet 52 in the state where the toner container 50 is attached to the attachment portion 34. As shown in FIG. 5, the operation portion 54 is provided at the right end of the container main body 55. The operation portion 54 includes a shaft 66 and a lever 67 (an example of the lever member). The shaft 66 is rotatably supported by the container main body 55. The lever 67 is fixed to the shaft 66 and extends from the shaft 66.

Figure 6A:
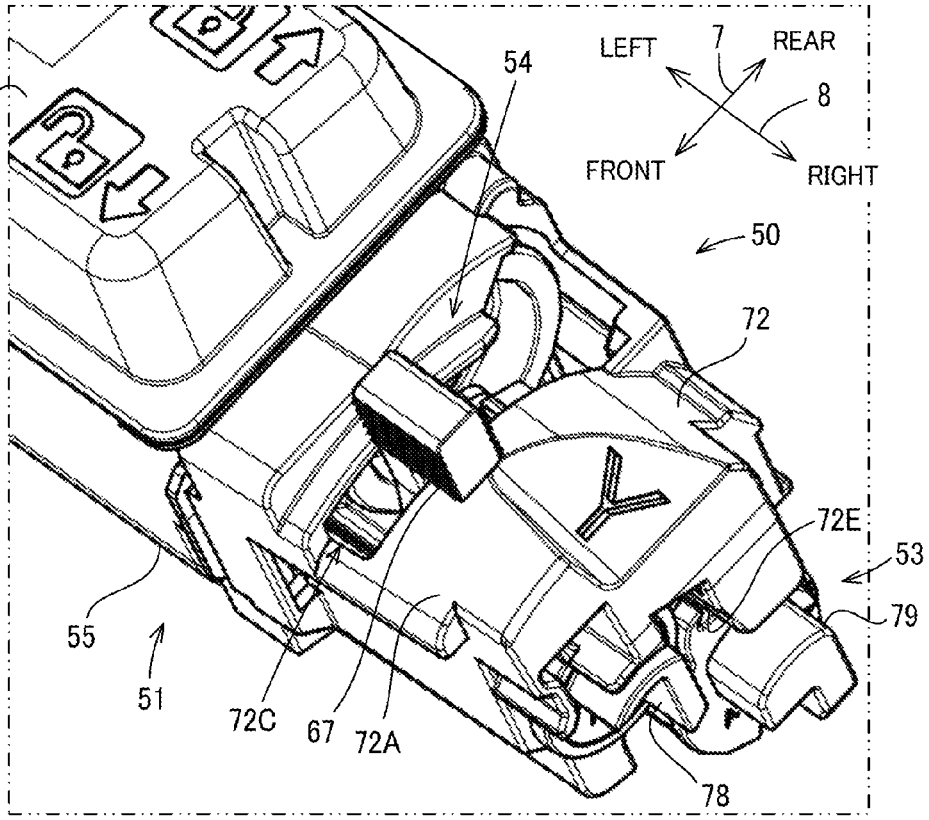
FIG. 6A and FIG. 6B are perspective views showing the configuration of the right side portion of the toner container in the state where the lever of the operation portion is pivoted.
Figure 6B:
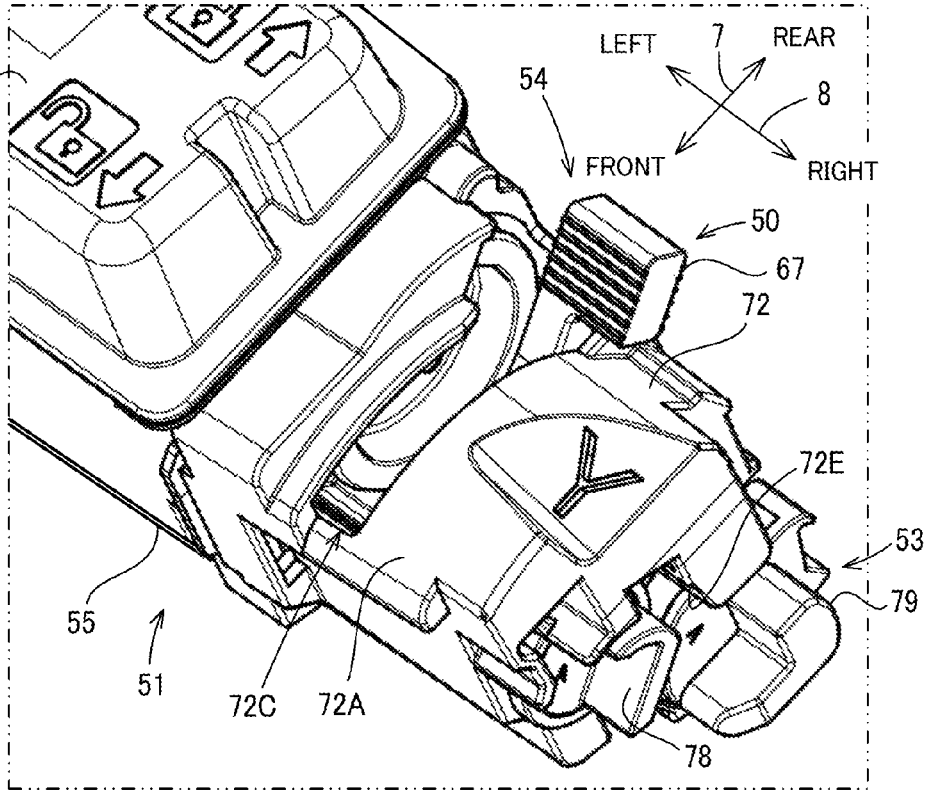

The shaft 66 includes a shaft core that extends rightward from the right end of the housing 51. The lever 67 is configured to integrally pivot with the shaft 66 around the shaft core of the shaft 66. In the present embodiment, the operation portion 54 can pivot between a first operation position (the attitude shown in FIG. 6A) and a second operation position (the attitude shown in FIG. 6B), wherein the lever 67 is inclined frontward in the first operation position, and is inclined rearward in the second operation position. In the present embodiment, with the operation of the lever 67 between the first operation position and the second operation position, the cylinder 61 of the opening/closing mechanism 53 is moved to the closing position corresponding to the first operation position, or to the opening position corresponding to the second operation position. Here, the first operation position is an attitude corresponding to the closing position of the cylinder 61. Specifically, when the cylinder 61 is to be maintained at the closing position or displaced to the closing position, the lever 67 is disposed at the first operation position. On the other hand, the second operation position is an attitude corresponding to the opening position of the cylinder 61. Specifically, when the cylinder 61 is to be maintained at the opening position or displaced to the opening position, the lever 67 is disposed at the second operation position.

In addition, a lock member 71 is provided at the right end of the container main body 55. The lock member 71 locks the operation portion 54 and the opening/closing mechanism 53 for the purpose of preventing them from mulfunctioning. That is, the lock member 71 locks the operation portion 54 so as to restrict the operation of the operation portion 54. Furthermore, the lock member 71 locks the opening/closing mechanism 53 so as to restrict the opening/closing operation of the opening/closing mechanism 53. The lock member 71 is integrally formed with a releasing portion 71A that is claw-like and projecting rightward. It is noted that since the lock member 71 is not a major component of the present disclosure, detailed description of the lock member 71 is omitted.

Figure 7B:
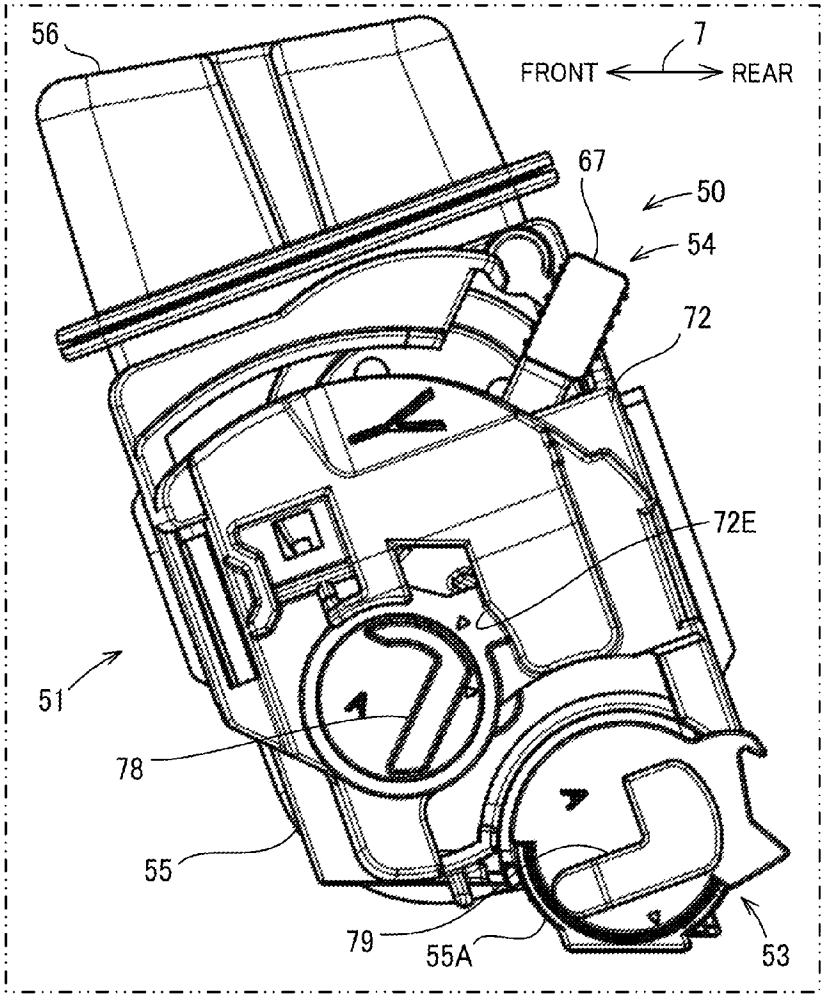
FIG. 7A and FIG. 7B are perspective views showing the positions of a first coupling portion and a second coupling portion corresponding to the operation positions of the lever of the operation portion.
Figure 7A:
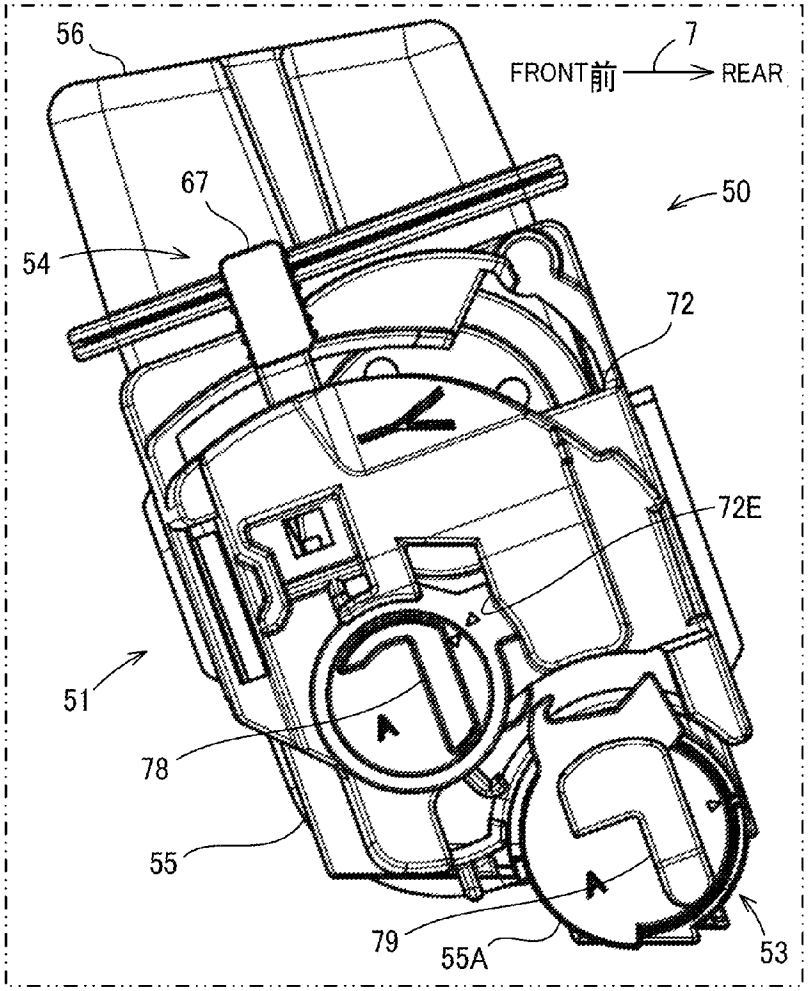

As shown in FIG. 4 and FIG. 5, the cover 72 is attached to the side wall 55B at the right end of the container main body 55. The cover 72 is attached in such a way as to cover the base part of the lever 67, the lock member 71 and the like. An arc-shaped slit 72C is formed in an upper wall 72A of the cover 72, and an upper end of the lever 67 extends out upward from the slit 72C to be exposed to outside. A right side wall 72B of the cover 72 has an opening 72D, and a first coupling portion 78 described below extends out rightward from the opening 72D to be exposed to outside. In addition, on the right side surface 72B, a guide groove 72E is formed, wherein the guide groove 72E extends vertically and is opened downward. As shown in FIG. 7A, the releasing portion 71A of the lock member 71 is exposed from the cover 72 at the guide groove 72E. It is noted that the second coupling portion 79 of the cylinder 61 is not covered with the cover 72.

The cover 72 includes a block-like positioning projection 73 projecting rightward from the right end of the container main body 55. The positioning projection 73 has a width which allows it to be fitted in the container guide 45 (see FIG. 3), the width being slightly smaller than the groove width of the container guide 45. This enables the positioning projection 73 to be attached to the container guide 45. Specifically, as shown in FIG. 3, when the positioning projection 73 is fitted in the container guide 45 and guided by the container guide 45 diagonally downward, the housing 51 is attached to the support plate 43.

Figure 9:
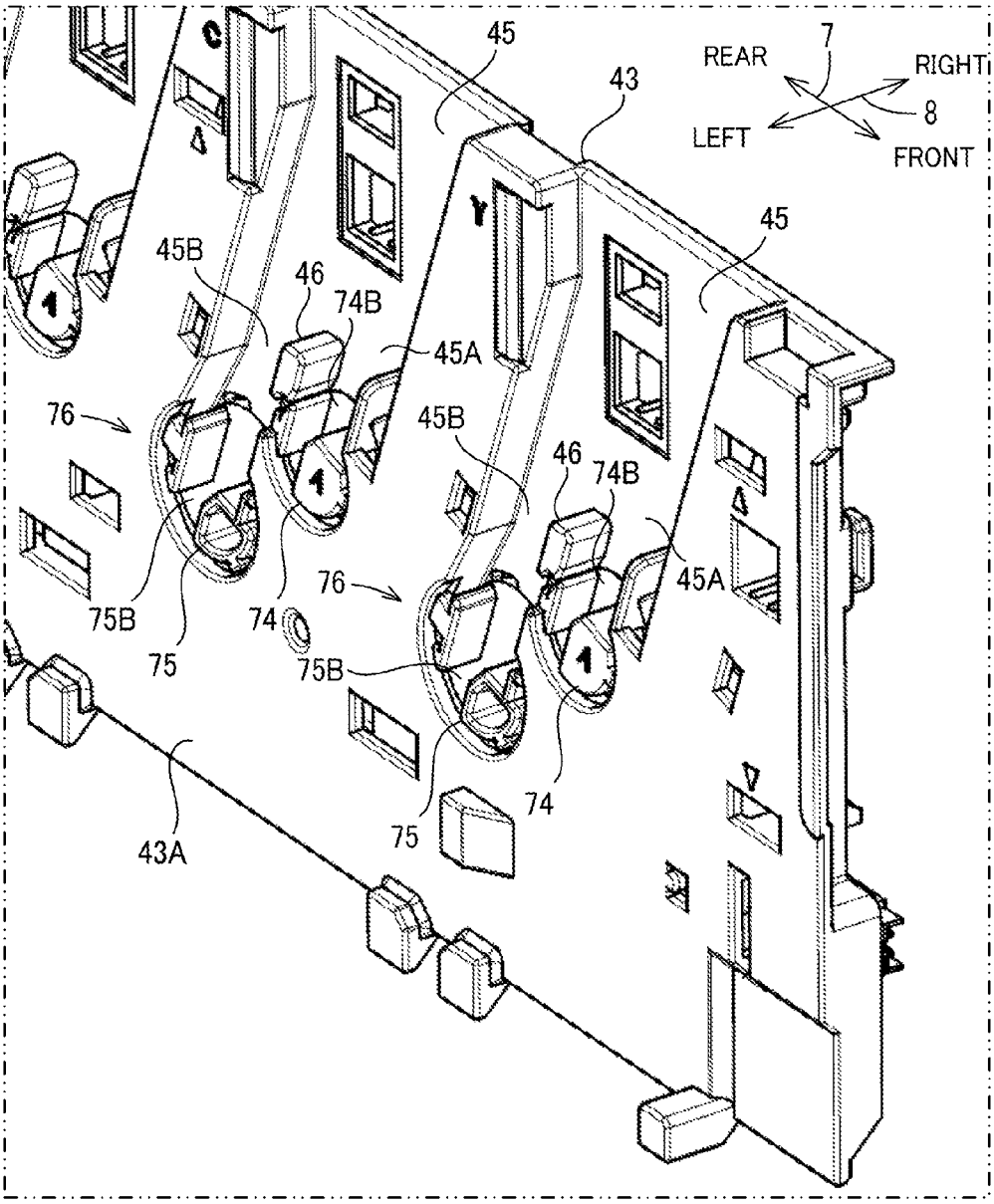
FIG. 9 is a diagram partially showing the configuration of a support plate of the attachment portion.
Figure 10A:
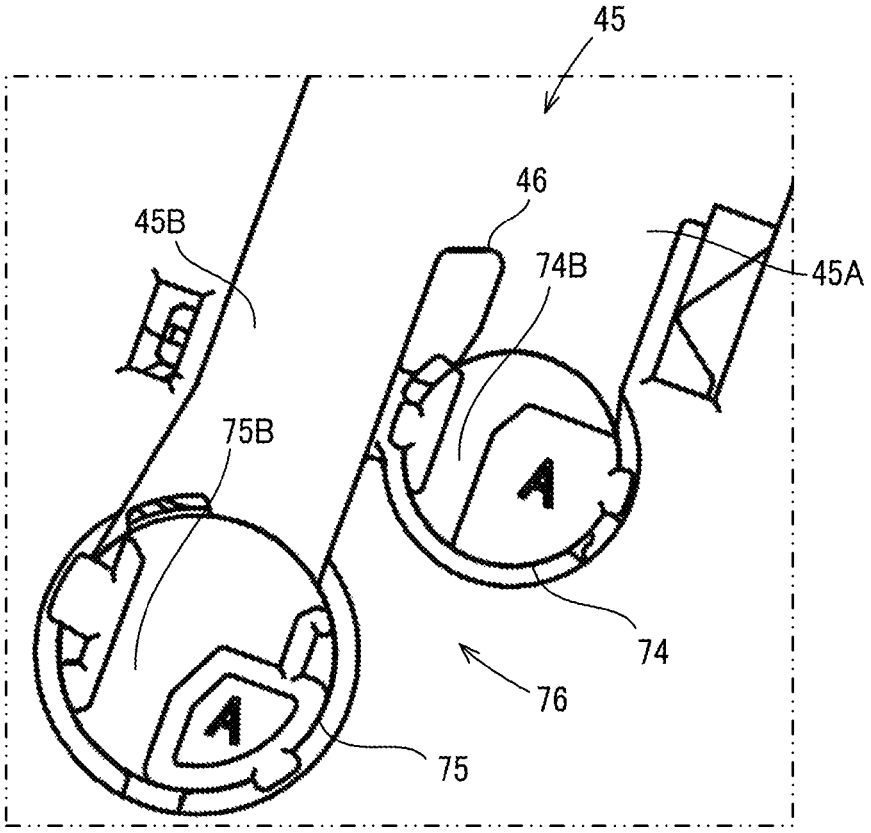
FIG. 10A and FIG. 10B are expanded views of a drive transmission mechanism.
Figure 10B:
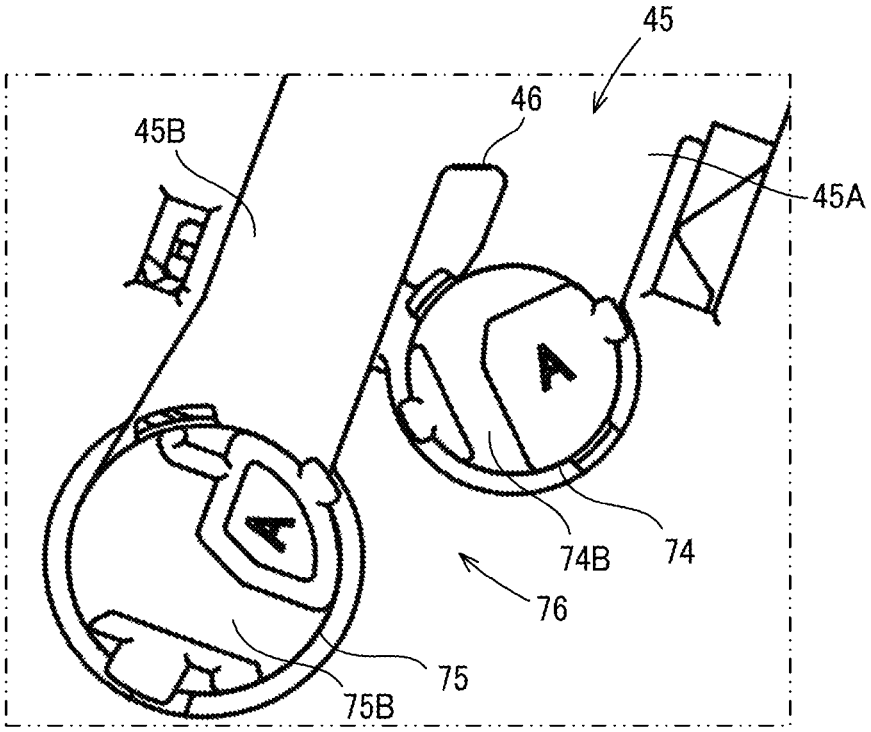
Figure 11:
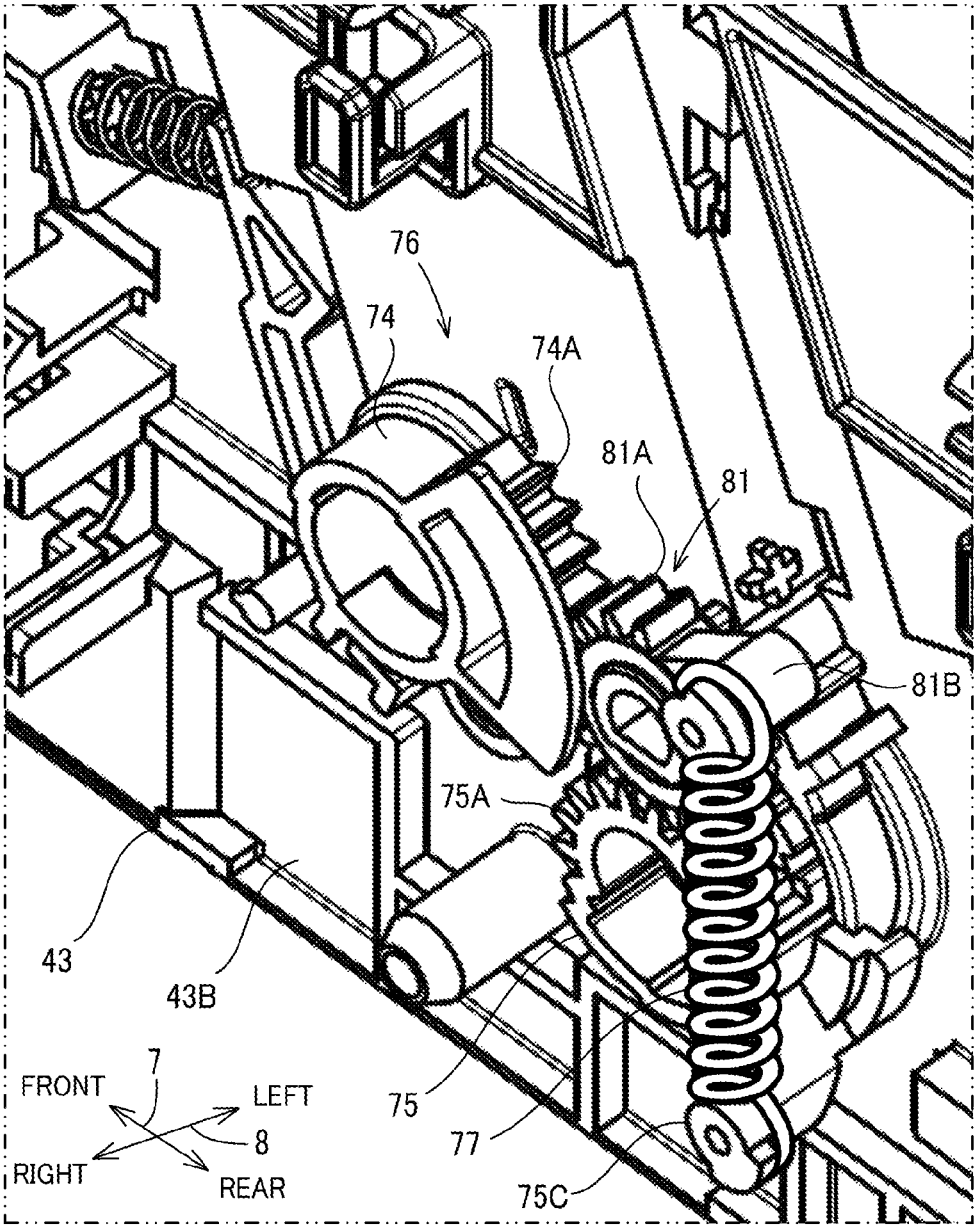
FIG. 11 is an expanded perspective view of the drive transmission mechanism.
Figure 12A:
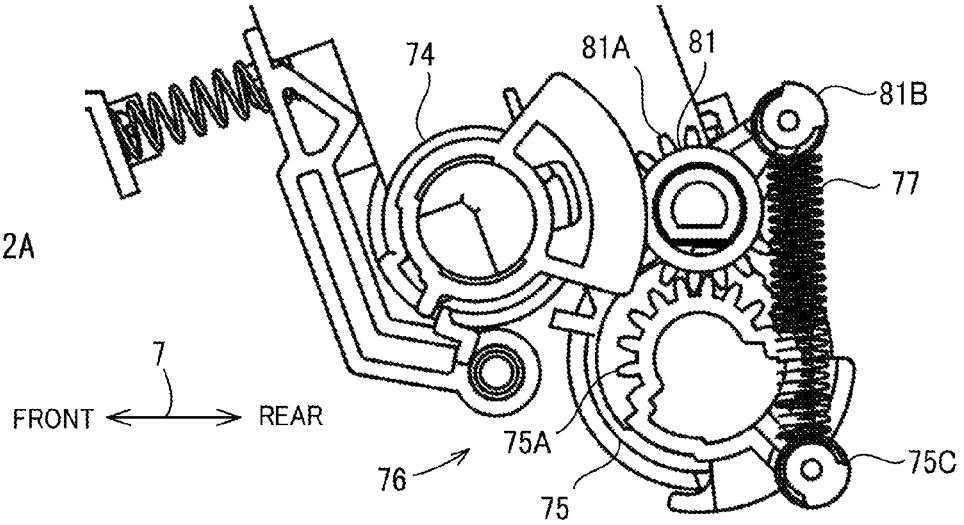
FIG. 12A to FIG. 12C are diagrams for explaining the operation of the drive transmission mechanism.
Figure 12B:
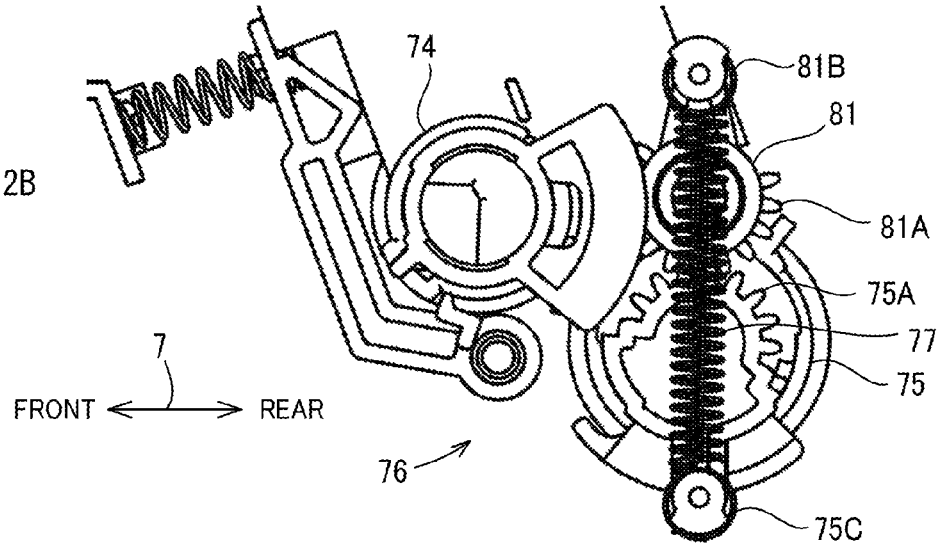
Figure 12C:
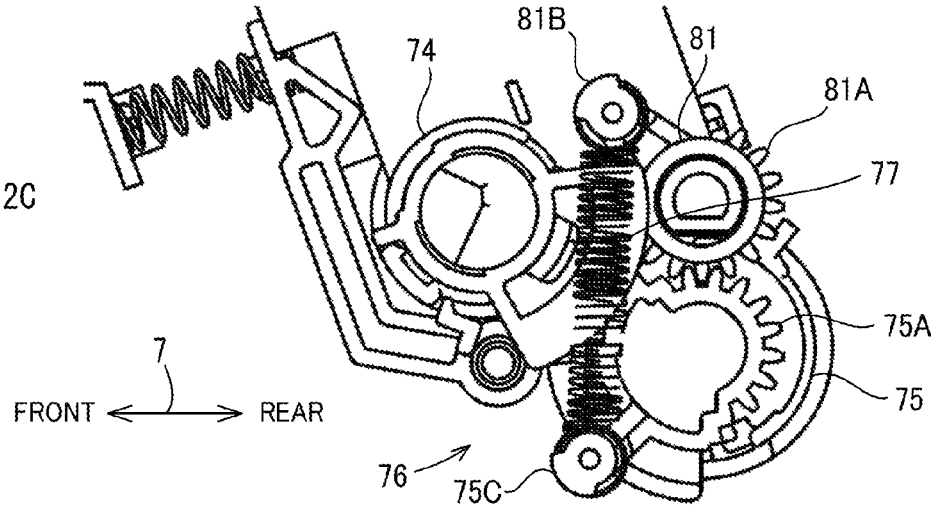

Here, FIG. 9 shows the outer appearance of the support plate 43. FIG. 10A, FIG. 10B, and FIG. 11 are expanded views of the drive transmission mechanism 76. FIG. 12A to FIG. 12C are diagrams for explaining the operation of the drive transmission mechanism 76. It is noted that FIG. 9 shows the support plate 43 viewed from a left side surface 43A. FIG. 10A and FIG. 10B are expanded views of the peripheral of one container guide 45 shown in FIG. 9. FIG. 11 shows the support plate 43 viewed from a right side surface 43B. FIG. 12A shows the state where the lever 67 is at the first operation position. FIG. 12B shows the state where the lever 67 is at an intermediate position between the first operation position and the second operation position. FIG. 12C shows the state where the lever 67 is at the second operation position.

As shown in FIG. 9, the drive transmission mechanism 76 is provided on the right side surface 43B of the support plate 43. The lower part of each container guide 45 of the support plate 43 is branched into a first groove portion 45A and a second groove portion 45B. An elongated projection portion 46 is formed between the first groove portion 45A and the second groove portion 45B, wherein the elongated projection portion 46 extends along the first groove portion 45A and the second groove portion 45B.

When the cover 72 is guided diagonally downward in the attachment direction by the container guide 45, the elongated projection portion 46 is inserted into the guide groove 72E of the cover 72. Subsequently, the upper part of the elongated projection portion 46 abuts on the releasing portion 71A of the lock member 71, and pushes up the lock member 71. In this way, when the toner container 50 is attached to the support plate 43, the lock member 71 abuts on the elongated projection portion 46 and operates in the lock release direction. This allows the lock state of the operation portion 54 and the opening/closing mechanism 53 by the lock member 71 to be released.

As shown in FIG. 10A, FIG. 10B, and FIG. 11, the apparatus main body 28 is provided with the drive transmission mechanism 76. The drive transmission mechanism 76 is provided on the support plate 43 constituting the apparatus main body 28. In the present embodiment, four drive transmission mechanisms 76 are provided in correspondence with the four toner containers 50. The drive transmission mechanisms 76 are provided in alignment in the front-rear direction 7 on the right side surface 43B of the support plate 43.

The drive transmission mechanism 76 is configured such that, when the lever 67 of the operation portion 54 is operated and an operation driving force (driving force) is input in the state where the toner container 50 is attached to the support plate 43, the drive transmission mechanism 76 transmits the operation driving force to the opening/closing mechanism 53.

The drive transmission mechanism 76 includes a first rotation portion 74 (input transmission portion), an intermediate rotation portion 81 (intermediate transmission portion), and a second rotation portion 75 (output transmission portion). The first rotation portion 74 is a portion that receives the operation driving force input from the operation portion 54 when the lever 67 of the operation portion 54 is operated. Upon receiving the operation driving force, the first rotation portion 74 transmits the operation driving force to the intermediate rotation portion 81. The intermediate rotation portion 81 is a portion that receives, from the first rotation portion 74, the operation driving force input by the operation of the lever 67 of the operation portion 54 and transmits the received operation driving force to the second rotation portion 75. The second rotation portion 75 is a portion that receives the operation driving force from the intermediate rotation portion 81 and outputs (transmits) the operation driving force to an external device (the opening/closing mechanism 53). In other words, the second rotation portion 75 receives the operation driving force transmitted from the first rotation portion 74 via the intermediate rotation portion 81, and outputs (transmits) the operation driving force to an external device (the opening/closing mechanism 53). The first rotation portion 74 is configured to rotate upon receiving the operation driving force. The intermediate rotation portion 81 is configured to rotate in conjunction with the first rotation portion 74. The second rotation portion 75 is configured to rotate in conjunction with the first rotation portion 74 and the intermediate rotation portion 81.

The first rotation portion 74 is disposed at the lower end of the first groove portion 45A of the container guide 45, and is rotatably supported by the support plate 43. On the other hand, the second rotation portion 75 is disposed at the lower end of the second groove portion 45B, and is rotatably supported by the support plate 43. The first rotation portion 74 and the second rotation portion 75 are separated from each other and are not configured to directly transmit the driving force to each other. The intermediate rotation portion 81 is provided between the first rotation portion 74 and the second rotation portion 75, and the intermediate rotation portion 81 is rotatably supported by the support plate 43. The intermediate rotation portion 81 is connected so as to be able to transmit a driving force to the first rotation portion 74 and the second rotation portion 75.

As shown in FIG. 11, the first rotation portion 74 is a rotator and includes a first gear portion 74A. The second rotation portion 75 is a rotator and includes a second gear portion 75A (gear portion). The intermediate rotation portion 81 is a rotator and includes an intermediate gear portion 81A (gear portion) that meshes with the first gear portion 74A and the second gear portion 75A respectively. The first gear portion 74A is integrally formed with the first rotation portion 74. The intermediate gear portion 81A is integrally formed with the intermediate rotation portion 81. The second gear portion 75A is integrally formed with the second rotation portion 75. As a result, when the first rotation portion 74 rotates in the state where the first gear portion 74A and the intermediate gear portion 81A mesh with each other and the intermediate gear portion 81A and the second gear portion 75A mesh with each other, the intermediate rotation portion 81 rotates reversely with respect to the rotational direction of the first rotation portion 74, and the second rotation portion 75 rotates in the same direction as the first rotation portion 74.

In the present embodiment, the first gear portion 74A and the second gear portion 75A are set such that the first rotation portion 74 and the second rotation portion 75 have the same rotation angle. Specifically, the first gear portion 74A and the second gear portion 75A have the same number of teeth and the same pitch. For example, the first gear portion 74A and the second gear portion 75A are set such that, when the first rotation portion 74 rotates 45 degrees together with the lever 67, the second rotation portion 75 also rotates 45 degrees.

In addition, as shown in FIG. 11, the drive transmission mechanism 76 includes a spring 77 (biasing member). The spring 77 biases the opening/closing mechanism 53 toward the closing position via the second rotation portion 75 when the lever 67 is positioned at the first operation position in the state where the toner container 50 is attached to the attachment portion 34. Furthermore, the spring 77 biases the opening/closing mechanism 53 toward the opening position via the second rotation portion 75 when the lever 67 is positioned at the second operation position in the state where the toner container 50 is attached to the attachment portion 34.

The spring 77 intervenes between the intermediate rotation portion 81 and the second rotation portion 75. The spring 77 is, for example, a coil spring. In the present embodiment, the spring 77 is attached in such a way as to be stretched and compressed with the rotation of the intermediate rotation portion 81 and the second rotation portion 75 in response to an operation of the lever 67. Specifically, the intermediate rotation portion 81 includes a first support piece 81B projecting outward in the radial direction from the outer circumferential surface thereof. The first support piece 81B is a portion to which one end portion of the spring 77 is fixed. That is, the first support piece 81B supports one end of the spring 77. Since the first support piece 81B pivots as the intermediate rotation portion 81 rotates, when the intermediate rotation portion 81 rotates, the position of the first support piece 81B supporting the spring 77 changes. The second rotation portion 75 includes a second support piece 75C projecting outward in the radial direction from the outer circumferential surface thereof. The second support piece 75C is a portion to which the other end portion of the spring 77 is fixed. That is, the second support piece 75C supports the other end of the spring 77. Since the second support piece 75C pivots as the intermediate rotation portion 81 rotates, when the intermediate rotation portion 81 rotates, the position of the second support piece 75C supporting the spring 77 changes.

As shown in FIG. 11, the spring 77 is attached between the first support piece 81B and the second support piece 75C. The spring 77 always generates a spring force in the compression direction, and is a so-called tension spring. In the present embodiment, as shown in FIG. 12B, when the first support piece 81B and the second support piece 75C are disposed on a line segment connecting between the center of the intermediate rotation portion 81 and the center of the second rotation portion 75, the spring forces of the spring 77 balance with each other, and the intermediate rotation portion 81 and the second rotation portion 75 maintain the stationary state. In this state, the spring 77 is maximally stretched. The positions of the lever 67 and the cylinder 61 when the spring forces of the spring 77 balance with each other are determined in advance. Specifically, in this state, the lever 67 is positioned at an intermediate position between the first operation position and the second operation position, and the cylinder 61 is positioned at an intermediate position between the opening position and the closing position. Here, the intermediate position of the lever 67 is an example of the predetermined position in an operation range of the lever 67 except for the first operation position and the second operation position.

In the state shown in FIG. 12B, when the lever 67 is operated from the intermediate position toward the first operation position, the balance of the spring 77 is released. Specifically, with the operation of the lever 67, the first rotation portion 74 allows the intermediate rotation portion 81 to rotate clockwise, and the intermediate rotation portion 81 allows the second rotation portion 75 to rotate counterclockwise. In this case, as shown in FIG. 12A, the spring 77 applies a force in the compression direction in such a way as to further allow the intermediate rotation portion 81 to rotate clockwise and further allow the second rotation portion 75 to rotate counterclockwise. At this time, even if no operation driving force is input to the lever 67 after it is operated from the intermediate position, the intermediate rotation portion 81 and the second rotation portion 75 are rotated only by the force of the spring 77. This allows the rotation of the second rotation portion 75 to be transmitted to the cylinder 61, and the cylinder 61 is displaced to the opening position by the biasing force of the spring 77 in a reliable manner.

On the other hand, in the state shown in FIG. 12B, when the lever 67 is operated from the intermediate position toward the second operation position, the balance of the spring 77 is released. Specifically, with the operation of the lever 67, the first rotation portion 74 allows the intermediate rotation portion 81 to rotate counterclockwise, and the intermediate rotation portion 81 allows the second rotation portion 75 to rotate clockwise. In this case, as shown in FIG. 12C, the spring 77 applies a force in the compression direction in such a way as to further allow the intermediate rotation portion 81 to rotate counterclockwise and further allow the second rotation portion 75 to rotate clockwise. At this time, even if no operation driving force is input to the lever 67 after it is operated from the intermediate position, the intermediate rotation portion 81 and the second rotation portion 75 are rotated only by the force of the spring 77. This allows the rotation of the second rotation portion 75 to be transmitted to the cylinder 61, and the cylinder 61 is displaced to the closing position by the biasing force of the spring 77 in a reliable manner.

As shown in FIG. 4 and FIG. 5, the operation portion 54 includes the first coupling portion 78 that is rotated when the lever 67 is operated. The first coupling portion 78 is integrally formed with the right end of the shaft 66. The first coupling portion 78 is formed in the shape of a plate that projects rightward from the right end of the shaft 66. The first coupling portion 78 extends in the attachment direction (namely, diagonally downward) in which the cover 72 is guided by the container guide 45 when the housing 51 is attached to the support plate 43. The first coupling portion 78 is coupled with the first rotation portion 74 of the drive transmission mechanism 76 in the state where the toner container 50 is attached to the container guide 45 of the support plate 43. That is, the first coupling portion 78 is coupled with the first rotation portion 74 in the state where the toner container 50 is attached. With this configuration, the operation driving force that is input when the operation portion 54 is operated is transmitted to the first rotation portion 74.

As shown in FIG. 10A and FIG. 10B, a first coupling groove 74B is formed in the first rotation portion 74 of the drive transmission mechanism 76 such that the first coupling portion 78 of the toner container 50 is coupled with the first coupling groove 74B. The first coupling groove 74B extends straight at least in part. On the other hand, the first coupling portion 78 is shaped so as to be fitted in the first coupling groove 74B. That is, the groove width of the first coupling groove 74B is approximately the same as the thickness of the first coupling portion 78. When the housing 51 is attached to the apparatus main body 28, the first coupling portion 78 is inserted into the first coupling groove 74B and is coupled therewith so as to be integrally rotatable with the first rotation portion 74.

As shown in FIG. 4 and FIG. 5, the opening/closing mechanism 53 of the toner container 50 includes the second coupling portion 79 that integrally rotates with the cylinder 61. The second coupling portion 79 is integrally formed with the right end of the cylinder 61. The second coupling portion 79 projects rightward from the right end of the cylinder 61. The second coupling portion 79 is formed in a shape of a hook in a cross section taken along a line that is perpendicular to the axis direction of the cylinder 61. The second coupling portion 79 receives the operation driving force from the second rotation portion 75 of the drive transmission mechanism 76. The second coupling portion 79 is coupled with the second rotation portion 75 of the drive transmission mechanism 76 in the state where the toner container 50 is attached to the container guide 45 of the support plate 43. That is, the second coupling portion 79 is coupled with the second rotation portion 75 in the state where the toner container 50 is attached. This enables the operation driving force to be transmitted to the second coupling portion 79 via the first rotation portion 74, the intermediate rotation portion 81 and the second rotation portion 75.

The second coupling portion 79 extends in the attachment direction (namely, diagonally downward) in which the cover 72 is guided by the container guide 45 when the housing 51 is attached to the support plate 43. The second coupling portion 79 is larger in thickness than the first coupling portion 78.

As shown in FIG. 10A and FIG. 10B, a second coupling groove 75B is formed in the second rotation portion 75 of the drive transmission mechanism 76 such that the second coupling portion 79 of the toner container 50 is coupled with the second coupling groove 75B. The second coupling groove 75B extends straight at least in part. On the other hand, the second coupling portion 79 (see FIG. 4 and FIG. 5) is shaped so as to be fitted in the second coupling groove 75B. That is, the groove width of the second coupling groove 75B is approximately the same as the thickness of the second coupling portion 79. As a result, the second coupling groove 75B and the first coupling groove 74B are different in groove width. When the housing 51 is attached to the support plate 43, the second coupling portion 79 is inserted into the second coupling groove 75B, and is coupled therewith so as to be integrally rotatable with the second rotation portion 75. The opening/closing mechanism 53 is configured such that the second coupling portion 79 and the second rotation portion 75 integrally rotate with each other, thereby the cylinder 61 is rotated in such a way as to open and close the toner discharge outlet 52.

Next, description is given of the attachment/detachment operation of the toner container 50 with respect to the apparatus main body 28.

Before the toner container 50 is attached to the apparatus main body 28, the toner discharge outlet 52 is closed by the cylinder 61, and the operation portion 54 and the opening/closing mechanism 53 are in the lock state by the lock member 71. At this time, as shown in FIG. 7A, the first coupling portion 78 and the second coupling portion 79 extend in the attachment direction (namely, diagonally downward) in which the cover 72 is guided by the container guide 45. In addition, the lever 67 is positioned at the first operation position, and the cylinder 61 is positioned at the closing position.

Furthermore, as shown in FIG. 10A, before the toner container 50 is attached to the apparatus main body 28, the first coupling groove 74B of the first rotation portion 74 and the second coupling groove 75B of the second rotation portion 75 in the drive transmission portion 76 are extending in the extension direction of the container guide 45 (namely, the attachment direction in which the cover 72 is guided).

When the toner container 50 is attached to the support plate 43, the cover 72 is inserted into the container guide 45 of the support plate 43. The cover 72 is then guided diagonally downward by the container guide 45. The first coupling portion 78 of the toner container 50 is guided by the first groove portion 45A, and the second coupling portion 79 is guided by the second groove portion 45B. Subsequently, the first coupling portion 78 is coupled with the first coupling groove 74B of the first rotation portion 74, and the second coupling portion 79 is coupled with the second coupling groove 75B of the second rotation portion 75.

In addition, while the cover 72 is guided by the container guide 45, the upper end of the elongated projection portion 46 abuts on the releasing portion 71A of the lock member 71 and pushes up the lock member 71. This allows the operation portion 54 and the opening/closing mechanism 53 of the toner container 50 to be released from the lock state in the state where the first coupling portion 78 is coupled with the first rotation portion 74 and the second coupling portion 79 is coupled with the second rotation portion 75.

Next, the toner discharge outlet 52 is opened by pivoting the lever 67 of the operation portion 54. Specifically, the lever 67 is pivoted from the first operation position (see FIG. 7A) toward the second operation position (see FIG. 7B). When the lever 67 of the operation portion 54 is pivoted in the state where the toner container 50 is attached to the support plate 43, the operation driving force is input to the first coupling portion 78 via the shaft 66 of the operation portion 54. This allows the shaft 66 and the first coupling portion 78 to be integrally rotated with the lever 67 clockwise (see FIG. 7B). That is, the first coupling portion 78 is rotated by the same angle as the pivoting angle of the lever 67.

The first coupling portion 78 is integrally rotated with the first rotation portion 74 of the drive transmission portion 76 because the first coupling portion 78 is coupled with the first rotation portion 74. As shown in FIG. 9, in the apparatus main body 28 side, the first gear portion 74A of the first rotation portion 74 meshes with the intermediate gear portion 81A of the intermediate rotation portion 81, and the intermediate gear portion 81A meshes with the second gear portion 75A of the second rotation portion 75. This allows the operation driving force to be transmitted from the first rotation portion 74 to the second rotation portion 75 via the intermediate rotation portion 81, and the second rotation portion 75 rotates in the same rotation direction as the first rotation portion 74.

The second rotation portion 75 is integrally rotated with the second coupling portion 79 of the toner container 50 because the second rotation portion 75 is coupled with the second coupling portion 79. With the rotation of the second coupling portion 79, the cylinder 61 integrally rotates with the second coupling portion 79 toward the opening position.

At this time, with the pivoting operation of the lever 67, the spring 77 is gradually stretched, and the user feels a burden when operating the lever 67. However, after the lever 67 passes the intermediate position between the first operation position and the second operation position, the lever 67 is automatically pivoted to the second operation position by the force of the spring 77 in the compression direction without operation of the lever 67. As shown in FIG. 12C, in the state where the lever 67 has reached the second operation position, the second rotation portion 75 receives, from the spring 77, a force that allows the cylinder 61 to rotate toward the opening position. As a result, if a portion from the first gear portion 74A to the second gear portion 75A has a gear loss, the second rotation portion 75 is disposed at a position corresponding to the opening position without being affected by the gear loss. Consequently, the toner discharge outlet 52 is displaced to the opening position in a reliable manner. In addition, since the user does not need to operate the lever 67 to the second operation position, the operability of the lever 67 is improved. Furthermore, since the user can clearly recognize the switching between the opening and closing of the toner discharge outlet 52, it is possible to provide an excellent operation feeling.

When the toner discharge outlet 52 is closed, the lever 67 is pivoted from the second operation position (see FIG. 7B) toward the first operation position (see FIG. 7A). This pivoting allows the shaft 66 and the first coupling portion 78 to be integrally rotated with the lever 67 counterclockwise (see FIG. 7A). That is, the first coupling portion 78 is rotated by the same angle as the pivoting angle of the lever 67.

As shown in FIG. 9, in the apparatus main body 28 side, the operation driving force is transmitted from the first rotation portion 74 to the second rotation portion 75 via the intermediate rotation portion 81, and the second rotation portion 75 rotates in the same rotation direction as the first rotation portion 74. Here, since the second rotation portion 75 is coupled with the second coupling portion 79 of the toner container 50, the second coupling portion 79 integrally rotates with the second rotation portion 75. With the rotation of the second coupling portion 79, the cylinder 61 integrally rotates with the second coupling portion 79 toward the closing position.

At this time, with the pivoting operation of the lever 67, the spring 77 is gradually stretched, and the user feels a burden when operating the lever 67. However, after the lever 67 passes the intermediate position between the first operation position and the second operation position, the lever 67 is automatically pivoted to the first operation position by the force of the spring 77 in the compression direction without operation of the lever 67. As shown in FIG. 12A, in the state where the lever 67 has reached the first operation position, the second rotation portion 75 receives, from the spring 77, a force that allows the cylinder 61 to rotate toward the closing position. As a result, if a portion from the first gear portion 74A to the second gear portion 75A has a gear loss, the second rotation portion 75 is disposed at a position corresponding to the closing position without being affected by the gear loss. Consequently, the toner discharge outlet 52 is displaced to the closing position in a reliable manner. In this case, too, the operability of the lever 67 is improved for the user, and the user can have an excellent operation feeling.

It is noted that when a conventional drive transmission mechanism that does not include the spring 77 intervenes between the lever 67 and the opening/closing mechanism 53, there may occur a problem that the opening/closing mechanism 53 is not displaced to the opening position or the closing position due to the transmission loss of the drive transmission mechanism. Here, when the opening/closing mechanism 53 is not disposed at the opening position correctly, the toner discharge outlet 52 is not opened completely, and discharging of toner is not performed smoothly. In addition, when the opening/closing mechanism 53 is not disposed at the closing position correctly, when the toner container 50 is removed from the apparatus main body 28, toner leaks out from the gap of the toner discharge outlet 52, and the toner smears the peripheral of the attachment portion of the toner container 50. However, according to the present embodiment, with the presence of the drive transmission mechanism 76 having the above-described configuration, the cylinder 61 of the opening/closing mechanism 53 is correctly displaced to the opening position or the closing position, and the toner discharge outlet 52 is opened and closed completely.

In the present embodiment, as described above, a coil spring is used as the spring 77. However, this is a mere example, and any biasing member is applicable as far as it can exert the function of the spring 77.

In the above-described embodiment, the first gear portion 74A and the second gear portion 75A are set such that the rotation angle of the first rotation portion 74 is the same as the rotation angle of the second rotation portion 75. However, the present disclosure is not limited to this configuration. For example, the first gear portion 74A and the second gear portion 75A may be set such that the rotation angle of the second rotation portion 75 is larger than the rotation angle of the first rotation portion 74. Specifically, the first gear portion 74A and the second gear portion 75A may be set such that when the lever 67, together with the first rotation portion 74, is rotated 45 degrees from the first operation position, the second rotation portion 75 is rotated 90 degrees. In this case, the spring 77 is maximally stretched before the lever 67 that is pivoted from the first operation position reaches the intermediate position, and thereafter, the spring 77 applies a biasing force in the compression direction. That is, with this configuration, the spring 77 is maximally stretched when the lever 67 is disposed at a position that is located between the first operation position and the intermediate position in the operation range of the lever 67. In this case, the user can displace the toner discharge outlet 52 from the closing position to the opening position by slightly pivoting the lever 67 after the attachment of the toner container 50.

In addition, the first gear portion 74A and the second gear portion 75A may be set such that the rotation angle of the second rotation portion 75 is smaller than the rotation angle of the first rotation portion 74. Specifically, the first gear portion 74A and the second gear portion 75A may be set such that when the lever 67, together with the first rotation portion 74, is rotated by 90 degrees from the first operation position, the second rotation portion 75 is rotated 45 degrees. In this case, the spring 77 is maximally stretched after the lever 67 that is pivoted from the first operation position passes the intermediate position and is further pivoted to some extent, and thereafter, the spring 77 applies a biasing force in the compression direction. That is, with this configuration, the spring 77 is maximally stretched when the lever 67 is disposed at a position that is located between the intermediate position and the second operation position in the operation range of the lever 67. In this case, the user can displace the toner discharge outlet 52 from the opening position to the closing position by slightly pivoting the lever 67 in the state where the toner discharge outlet 52 is opened after the attachment of the toner container 50.

In the above-described embodiment, a configuration where the operation portion 54 is provided on the toner container 50 is described as an example. However, the present disclosure is applicable to a configuration where the operation portion 54 is provided in the apparatus main body 28 side.

In addition, in the above-described embodiment, a configuration where the image forming apparatus 10 includes four toner containers 50 is described as an example. However, the present disclosure is applicable to a configuration where the image forming apparatus 10 includes one toner container 50.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner case attached to an apparatus main body;

an opening/closing member configured to open and close a toner discharge outlet formed in the toner case;

a lever member configured to be operated between a first operation position and a second operation position for the opening/closing member to be moved to a closing position corresponding to the first operation position or to an opening position corresponding to the second operation position;

a drive transmission mechanism configured to transmit, to the opening/closing member, a driving force that is input by an operation of the lever member; and a biasing member configured to bias the opening/closing member toward the closing position when the lever member is at the first operation position, and bias the opening/closing member toward the opening position when the lever member is at the second operation position.

2. The image forming apparatus according to claim 1, wherein the drive transmission mechanism includes an input transmission portion, an intermediate transmission portion, and an output transmission portion, the input transmission portion receiving the driving force that is input to the lever member, the intermediate transmission portion receiving the driving force from the input transmission portion, the output transmission portion receiving the driving force from the intermediate transmission portion and transmitting the driving force to the opening/closing member, and the biasing member intervenes between the intermediate transmission portion and the output transmission portion.

3. The image forming apparatus according to claim 2, wherein the intermediate transmission portion and the output transmission portion are rotators that respectively include gear portions that are meshed with each other, and the biasing member is a spring member that is stretched and compressed with rotation of the intermediate rotation portion and the output transmission portion in response to an operation of the lever member.

4. The image forming apparatus according to claim 3, wherein the biasing member is maximally stretched when the lever member is positioned at a predetermined position between the first operation position and the second operation position in an operation range of the lever member.

5. The image forming apparatus according to claim 4, wherein the predetermined position is located between the first operation position and the intermediate operation position in the operation range.

6. The image forming apparatus according to claim 4, wherein the predetermined position is located between the intermediate operation position and the second operation position in the operation range.

7. The image forming apparatus according to claim 2, wherein the toner case includes the lever member and the opening/closing member, and the apparatus main body includes the drive transmission mechanism and the biasing member.

8. The image forming apparatus according to claim 7, wherein the lever member includes a first coupling portion configured to be coupled with the input transmission portion and transmit the driving force to the input transmission portion in a state where the toner case is attached to the apparatus main body, and the opening/closing member includes a second coupling portion configured to be coupled with the output transmission portion and receive the driving force from the output transmission portion in the state where the toner case is attached to the apparatus main body.

* * * * *